US005525954A

United States Patent [19]

Komazaki et al.

[11] Patent Number: 5,525,954

[45] Date of Patent: Jun. 11, 1996

[54] STRIPLINE RESONATOR

[75] Inventors: Tomokazu Komazaki; Katsuhiko Gunji; Toshikazu Yasuoka; Kohichiro Shimizu; Hiroyuki Horii; Yoshio Okada; Masao Iwata; Kazushige Nogichi, all of Tokyo, Japan

[73] Assignee: Oki Electric Industry Co., Ltd., Tokyo, Japan

[21] Appl. No.: 277,289

[22] Filed: Jul. 22, 1994

[30] Foreign Application Priority Data

| | | | |
|---|---|---|---|
| Aug. 9, 1993 | [JP] | Japan | 5-197363 |
| Jan. 31, 1994 | [JP] | Japan | 6-009795 |

[51] Int. Cl.[6] ..... H01P 7/08

[52] U.S. Cl. ..... 333/219; 333/222

[58] Field of Search ..... 333/204, 205, 333/219, 222, 223, 235

[56] References Cited

U.S. PATENT DOCUMENTS

| | | | |
|---|---|---|---|
| 3,668,552 | 6/1972 | Kuno et al. | 333/222 X |
| 4,731,596 | 3/1988 | Cruchon et al. | 333/204 |
| 5,057,803 | 10/1991 | Ooi et al. | 333/204 |

FOREIGN PATENT DOCUMENTS

| | | |
|---|---|---|
| 0222445 | 5/1987 | European Pat. Off. . |
| 1-101701 | 4/1989 | Japan . |
| 3-73602 | 3/1991 | Japan . |
| 5-191103 | 7/1993 | Japan . |
| 2223371 | 4/1990 | United Kingdom . |

OTHER PUBLICATIONS

Applied Physics Letters, vol. 54, No. 26, Jun. 26, 1989, pp. 2710–2712, "Measurements of the Magnetic Penetration Depth in $YBa_2Cu_3O_{7-\delta}$ Thin Films By The Microstrip Resonator Technique", S. M. Anlage et al.

*Primary Examiner*—Paul Gensler
*Attorney, Agent, or Firm*—Spencer & Frank

[57] ABSTRACT

A stripline resonator is constructed of a dielectric plate having a ground electrode formed on a side surface thereof, an open-ended λ/2 long stripline arranged on a top surface of the dielectric plate, an input terminal to which signals are inputted, said input terminal is connected to one end of the open-ended λ/2 long stripline, a first reactance element connected either in series or in parallel between the input terminal and the open-ended λ/2 long stripline, and a second reactance element connected at one end thereof to an opposite end of the open-ended λ/2 long stripline and at an opposite end to a ground electrode.

10 Claims, 10 Drawing Sheets

| C2 (pF) | fo(GHZ) | Q | L (nH) |
|---|---|---|---|
| 1.0 | 1.47 | 91.5 | 1.09 |
| 2.0 | 1.39 | 100.1 | 1.17 |
| 3.0 | 1.33 | 123.4 | 1.23 |
| 4.0 | 1.21 | 90.1 | 1.33 |
| 0 | 1.53 | 58.6 | 2.15 |

FIG. 15

| Co (pF) | C1 | C2 | C3 | fo (GHZ) | Q | L (nH) |
|---|---|---|---|---|---|---|
| 0 | 0 | 0 | 0 | 1.04 | 69.1 | 1.69 |
| 1.0 | 3.0 | 3.0 | 3.0 | 1.25 | 519.1 | 1.55 |
| 2.0 | 3.0 | 3.0 | 3.0 | 1.04 | 304.2 | 1.59 |
| 3.0 | 3.0 | 3.0 | 3.0 | 0.76 | 187.5 | 1.99 |

(PRIOR ART)

STRIPLINE RESONATOR

BACKGROUND OF THE INVENTION

This invention relates to a filter suitable for use in a high-frequency band in a communication equipment, especially a mobile radiophone.

A conventional stripline resonator is illustrated in FIG. 16. Referring to FIG. 16, the conventional stripline resonator is described. A side surface 104 and a bottom surface 105 of a dielectric plate 101 are metallized or plated over the entire surfaces thereof. The metallized or plated side surface 104 and bottom surface 105 are electrically maintained at the ground potential. A stripline resonator 103 is formed on a top surface 102 of the dielectric plate 101. The stripline resonator 103 is connected at one end thereof to an input terminal 108. At an area on the top surface 102, said area being apart by a predetermined distance from an opposite end of the stripline resonator 103, a marginal portion 106 is formed in such a way that the marginal portion is plated in continuation with the side surface 104. The opposite end of the stripline resonator 103 is connected to the marginal portion 106 via a lumped-constant element such as a capacitor 107.

As a consequence, capacitance C is realized between the opposite end of the stripline resonator 103 and the side surface 104 which forms a ground electrode, whereby the stripline resonator 103 is equipped with an increased quality factor Q.

SUMMARY OF THE INVENTION

An object of the present invention is to provide a stripline resonator having a still higher quality factor Q.

Another object of the present invention is to provide a stripline resonator which requires a small mounting area.

In one aspect of the present invention, there is thus provided a stripline resonator comprising:

an input terminal;

an open-ended λ/2 long stripline arranged on a dielectric plate; and a reactance element connected at one end thereof to said input terminal and at an opposite end thereof to one end of said open-ended λ/2 long stripline. The stripline resonator may further comprise a reactance element connected at one end thereof to an opposite end of said open-ended λ/2 long stripline.

According to the present invention, the stripline can be divided and arranged on plural dielectric plates and these dielectric plates can be arranged in a multilayer structure.

Owing to the construction described above, the stripline resonator according to the present invention is equipped with a high quality factor and requires only a small mounting area.

BRIEF DESCRIPTION OF THE DRAWINGS

FIG. 15 illustrates a table of experimental data of a stripline divided into three parts.

DETAILED DESCRIPTION OF THE PREFERRED EMBODIMENTS

Figure 1:
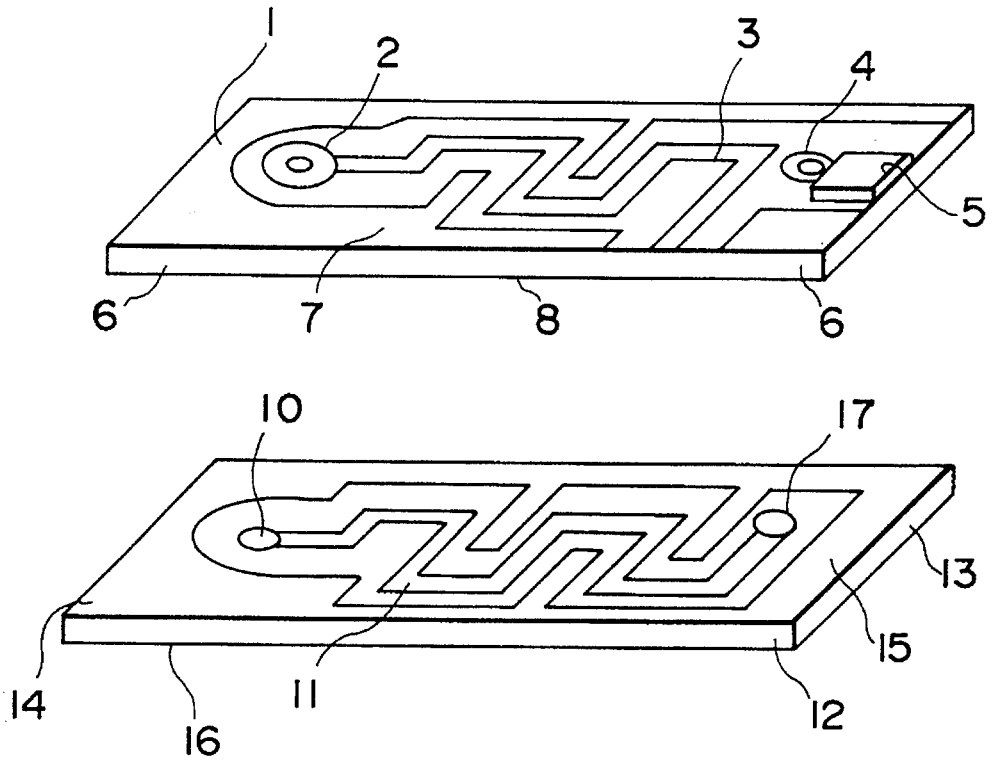
FIG. 1 is a perspective view of a stripline resonator according to a first embodiment of this invention.

The stripline resonator according to the first embodiment of this invention is first described with reference to FIGS. 1 and 2. Referring first to FIG. 1, arranged on a top surface 7 of a dielectric plate 1 are an input terminal 2, a short-ended stripline 3, a terminal 4 and a capacitor 5. The short-ended stripline 3 forms an inductance component with a length shorter than λ/2. The short-ended stripline 3 is connected at one end thereof to the input terminal 2 and at an opposite end to a side surface 6. The input terminal 2 and the terminal 4 centrally define through-holes, respectively. These through-holes extend from the top surface 7 to a bottom surface 8. An inner wall of each through-hole is metallized or plated (hereinafter collectively called "plated"). On the bottom surface 8, electrode patterns of the same shape as the input terminal 2 are formed around outer peripheries of the through-holes, respectively. The terminal 4 and the side surface 6 are connected together via the capacitor 5.

On the other hand, contacts 10,17 and an open-ended λ/2 long stripline 11 are formed on a top surface 15 of a dielectric plate 14 of the same shape and dimensions as the dielectric plate 1. The open-ended λ/2 long stripline 11 is connected at one end thereof to the contact 10 and at an opposite end thereof to the contact 17.

The top surface 7 of the dielectric plate 1 is plated except for areas—where the input terminal 2, the short-ended stripline 3, the terminal 4 and the capacitor 5 are arranged, respectively—and areas extending over a predetermined distance from the contours of the first-mentioned areas. The side surface 6 of the dielectric plate 1 is plated over the entire area thereof in continuation with the plated area of the top surface 7. The bottom surface 8 of the dielectric plate 1 is plated except for an area, which is brought into contact with the open-ended λ/2 long stripline 11 when the dielectric plate 1 and the dielectric plate 14 are stacked together, and an area extending over a predetermined distance from the contour of the first-mentioned area.

Similarly, the top surface 15 of the dielectric plate 14 is plated except for areas—where the contact 10, the contact 17 and the open-ended λ/2 long stripline 11 are arranged, respectively—and areas extending over a predetermined distance from the contours of the first-mentioned areas. The side surface 13 of the dielectric plate 14 is plated over the entire area thereof in continuation with the plated area of the top surface 15. The bottom surface 16 of the dielectric plate 14 is plated over the entire area thereof in continuation with the side surface 13.

These plated surfaces are electrically maintained at the ground potential.

When the dielectric plate 1 and the dielectric plate 14 are stacked together, the input terminal 2 and the contact 10 as well as the terminal 4 and the contact 17 are electrically connected via the plated inner walls of their corresponding through-holes. Accordingly, the stripline resonator of FIG. 1 can be represented by the equivalent circuit depicted in FIG. 2.

Figure 2:
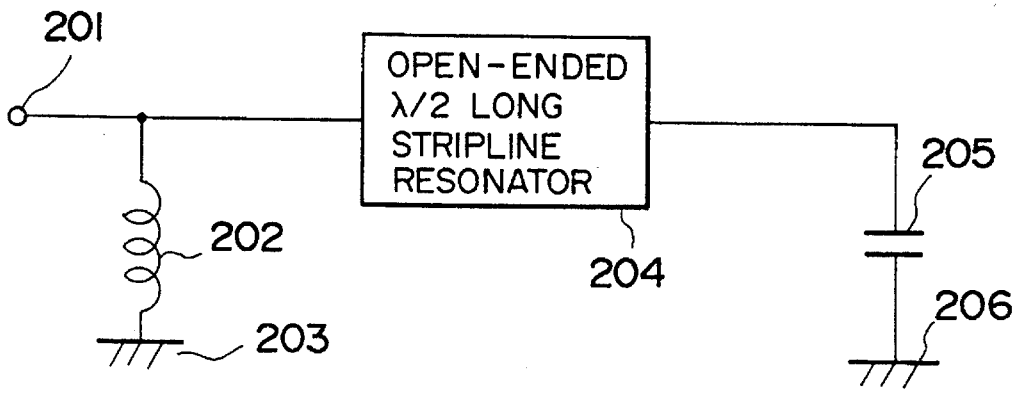
FIG. 2 is an equivalent circuit diagram of the stripline resonator in FIG. 1.

In FIG. 2, an input terminal 201 is connected to one end of an open-ended λ/2 long stripline resonance circuit 204. An inductance 202 is connected at one end thereof in parallel between the input terminal 201 and the open-ended λ/2 long stripline resonator 204 and at an opposite end to a ground 203. An opposite end of the open-ended λ/2 long stripline resonator 204 is connected to a ground 206 via a capacitance 205. The route of the input terminal 201→the open-ended λ/2 long stripline resonance circuit 204→the capacitance 205→the ground 206 in FIG. 2 is therefore equivalent to the route of the input terminal 2→the contact 10→the open-ended λ/2 long stripline 11→the contact 17→the terminal 4→the capacitor 5→the side surface 6 in FIG. 1. Further, the route of the input terminal 201→the inductance 202→the ground 203 in FIG. 2 is equivalent to the route of the input terminal 2→the short-ended stripline 3→the side surface 6 in FIG. 1.

When an inductance $L_o$ is connected in parallel to an input terminal, the impedance $Z_{in}$ and quality factor Q can be expressed by the following formulas (1) and (2):

$$Z_{in} = \frac{Z_0(1+Z_0\alpha l)\left\{\alpha l + Z_0 + j\frac{Z_0}{\omega L_0}(1+Z_0\alpha l)\right\}}{(\alpha l + Z_0)^2 + \frac{1}{\omega^2 L_0} Z_0^2(1+Z_0\alpha l)^2} \quad (1)$$

$$Q = \frac{Qs + Z_0}{1 + QsZ_0} \cdot \frac{Z_0}{\omega L_0} \quad (2)$$

where $Z_o$: characteristic impedance of a stripline, l: length of the stripline, al: 1/Q, n: 2, and Qs: Q of the stripline.

The above two formulas indicate that a high quality factor Q is therefore obtained by an increase in the imaginary part of the impedance.

Figure 3:
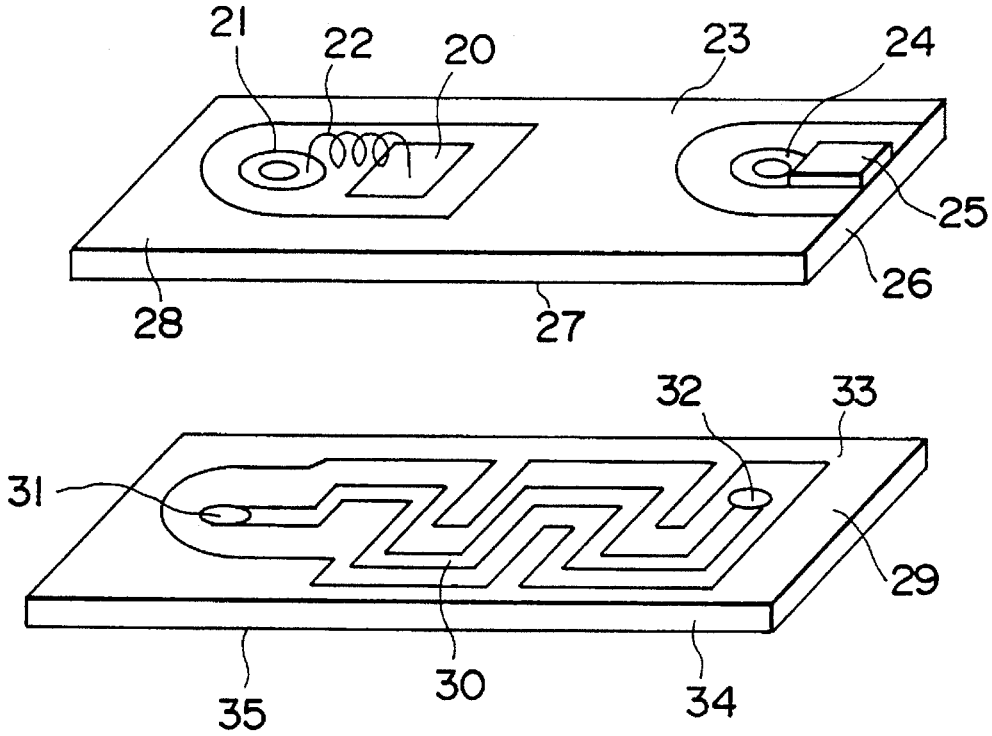
FIG. 3 is a perspective view of a stripline resonator according to a second embodiment of this invention.

The stripline resonator according to the second embodiment of this invention will next be described with reference to FIGS. 3 and 4. Referring first to FIG. 3, arranged on a top surface 28 of a dielectric plate 23 are an input terminal 20, a connecting terminal 21, a coil 22, a terminal 24 and a capacitor 25. The input terminal 20 is connected to the connecting terminal 21 via the coil 22, whereas the terminal 24 is connected to a side surface 26 via the capacitor 25. The connecting terminal 21 and the terminal 24 centrally define through-holes, respectively. These through-holes extend from the top surface 28 to a bottom surface 27. An inner wall of each through-hole is plated. On the bottom surface 27, electrode patterns of the same shape as the connecting terminal 21 are formed around outer peripheries of the through-holes, respectively.

On the other hand, contacts 31,32 and an open-ended λ/2 long stripline 30 are formed on a top surface 33 of a dielectric plate 29 of the same shape and dimensions as the dielectric plate 23. The open-ended λ/2 long stripline 30 is connected at one end thereof to the contact 31 and at an opposite end thereof to the contact 32.

The top surface 28 of the dielectric plate 23 is plated except for areas—where the input terminal 20, the connecting terminal 21, the coil 22, the terminal 24 and the capacitor 25 are arranged, respectively—and areas extending over a predetermined distance from the contours of the first-mentioned areas. The side surface 26 of the dielectric plate 23 is plated over the entire area thereof in continuation with the plated area of the top surface 28. The bottom surface 27 of the dielectric plate 23 is plated except for an area, which is brought into contact with the open-ended λ/2 long stripline 30 when the dielectric plate 23 and the dielectric plate 29 are stacked together, and an area extending over a predetermined distance from the contour of the first-mentioned area.

Similarly, the top surface 33 of the dielectric plate 29 is plated except for areas—where the contact 31, the open-ended λ/2 long stripline 30 and the contact 32 are arranged, respectively—and areas extending over a predetermined distance from the contours of the first-mentioned areas. The side surface 34 of the dielectric plate 29 is plated over the entire area thereof in continuation with the plated area of the top surface 33. The bottom surface 35 of the dielectric plate 29 is plated over the entire area thereof in continuation with the side surface 34.

These plated surfaces are electrically maintained at the ground potential.

When the dielectric plate 23 and the dielectric plate 29 are stacked together, the input terminal 21 and the contact 31 as well as the contact 32 and the terminal 24 are electrically connected via the plated inner walls of their corresponding through-holes. Accordingly, the stripline resonator of FIG. 3 can be represented by the equivalent circuit depicted in FIG. 4.

Figure 4:
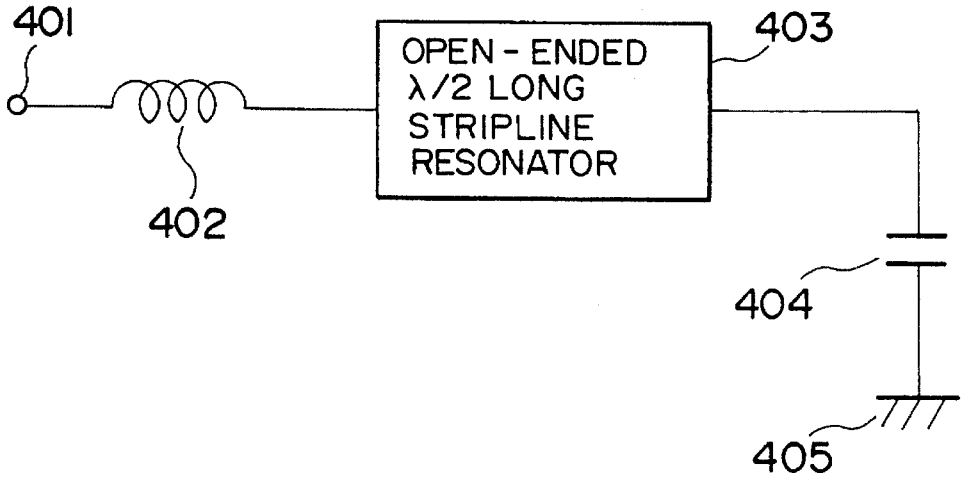
FIG. 4 is an equivalent circuit diagram of the stripline resonator in FIG. 3.

In FIG. 4, an input terminal 401 is connected to one end of an open-ended λ/2 long stripline resonance circuit 403 via an inductance 402. An opposite end of the open-ended λ/2 long stripline resonance circuit 403 is connected to a ground 405 via a capacitance 404. The route of the input terminal 401→the inductance 402→the open-ended λ/2 long stripline resonance circuit 403→the capacitance 404→the ground 405 in FIG. 4 is therefore equivalent to the route of the input terminal 20→the oil 22→the connecting terminal 21→the contact 31→the open-ended λ/2 long stripline 30→the contact 32→the terminal 24→the capacitor 25→the side surface 26 10 in FIG. 3.

When an inductance $L_o$ is connected in series to an input terminal, the input impedance $Z_{in}$ and the quality factor Q can be expressed by the following formulas as (3) and (4):

$$Z_{in}=\frac{Z_0(1+Z_0\alpha l)+j\omega L_0(\alpha l+Z_0)}{\alpha l+Z_0} \quad (3)$$

$$Q=\frac{QsZ_0+1}{Qs+Z_0}\cdot\frac{\omega_0 L_0}{Z_0} \quad (4)$$

where $Z_o$: characteristic impedance of a stripline, l: length of the stripline, al: 1/Q, n: 2, and Qs: Q of the stripline.

The above two formulas indicate that a high quality factor Q is therefore obtained by an increase in the imaginary part of the impedance.

The stripline resonator according to the third embodiment of this invention will now be described with reference to FIGS. 5 and 6. Referring first to FIG. 6, arranged on a top surface 42 of a dielectric plate 37 are an input terminal 36, a connecting terminal 47, a capacitor 41, a terminal 38 and a capacitor 39. The input terminal 36 is connected to the connecting terminal 47 via the capacitor 41, while the terminal 38 is connected to a side surface 40 via the capacitor 39. The connecting terminal 47 and the terminal 38 centrally define through-holes, respectively. These through-holes extend from the top surface 42 to a bottom surface 48. An inner wall of each through-hole is plated. On the bottom surface 48, electrode patterns of the same shape as the connecting terminal 47 or the input terminal 38 are formed around outer peripheries of the through-holes, respectively.

On the other hand, contacts 44,52 and an open-ended λ/2 long stripline 45 are formed on a top surface 49 of a dielectric plate 46 of the same shape and dimensions as the dielectric plate 37 The open-ended λ/2 long stripline 45 is connected at one end thereof to the contact 44 and at an opposite end thereof to the contact 52.

The top surface 42 of the dielectric plate 37 is plated except for areas—where the input terminal 36, the connecting terminal 47, the capacitor 41, the terminal 38 and the capacitor 39 are arranged, respectively —and areas extending over a predetermined distance from the contours of the first-mentioned areas. The side surface 40 of the dielectric plate 37 is plated over the entire area thereof in continuation with the plated area of the top surface 42. The bottom surface 48 of the dielectric plate 37 is plated except for an area, which is brought into contact with the open-ended λ/2 long stripline 45 when the bottom surface 48 of the dielectric plate 37 and the top surface 49 of the dielectric plate 48 are brought into a contiguous relation, and an area extending over a predetermined distance from the contour of the first-mentioned area.

Similarly, the top surface 49 of the dielectric plate 46 is plated except for areas—where the contact 44, the terminal 52 and the open-ended λ/2 long stripline 45 are arranged, respectively—and areas extending over a predetermined distance from the contours of the first-mentioned areas. The side surface 50 of the dielectric plate 46 is plated over the entire area thereof in continuation with the plated area of the top surface 49. The bottom surface 51 of the dielectric plate 46 is plated over the entire area thereof in continuation with the side surface 50.

When the dielectric plate 37 and the dielectric plate 46 are stacked together, the connecting terminal 47 and the contact 44 as well as the contact 52 and the terminal 38 are electrically connected together via the plated inner walls of their corresponding through-holes. As a consequence, the stripline resonator in FIG. 5 can be represented by the equivalent circuit of FIG. 6.

In FIG. 6, an input terminal 601 is connected to one end of an open-ended λ/2 long stripline resonance circuit 603 via a capacitance 602 and an opposite end of the open-ended λ/2 long stripline resonance circuit 603 is connected to a ground 605 via a capacitance 604. The route of the input terminal 601→the capacitance 602→the open-ended λ/2 long stripline resonance circuit 603→the capacitance 604→the ground 605 in FIG. 6 is equivalent to the route of the input terminal 36→the capacitor 41→the connecting terminal 47→the contact 44→the open-ended λ/2 long stripline 45→the contact 52→the terminal 38→the capacitor 39→the side surface 40 in FIG. 5.

When a capacitance Co is connected in series to an input terminal, the input impedance $Z_{in}$ and the quality factor Q can be expressed by the following formulas (5) and (6):

$$Z_{in}=\frac{Z_0(1+Z_0\alpha l)+\frac{1}{j\omega c}(\alpha l+Z_0)}{\alpha l+Z_0} \quad (5)$$

$$Q=\frac{QsZ_0+1}{Qs+Z_0}\cdot\frac{1}{\omega_0 C_2} \quad (6)$$

where $Z_o$: characteristic impedance of a stripline, l: length of the stripline, al: 1/Q, n: 2, and Qs: $^{Q}$ of the stripline.

The above two formulas indicate that a high quality factor Q is therefore obtained by an increase in the imaginary part of the impedance.

Figure 7:
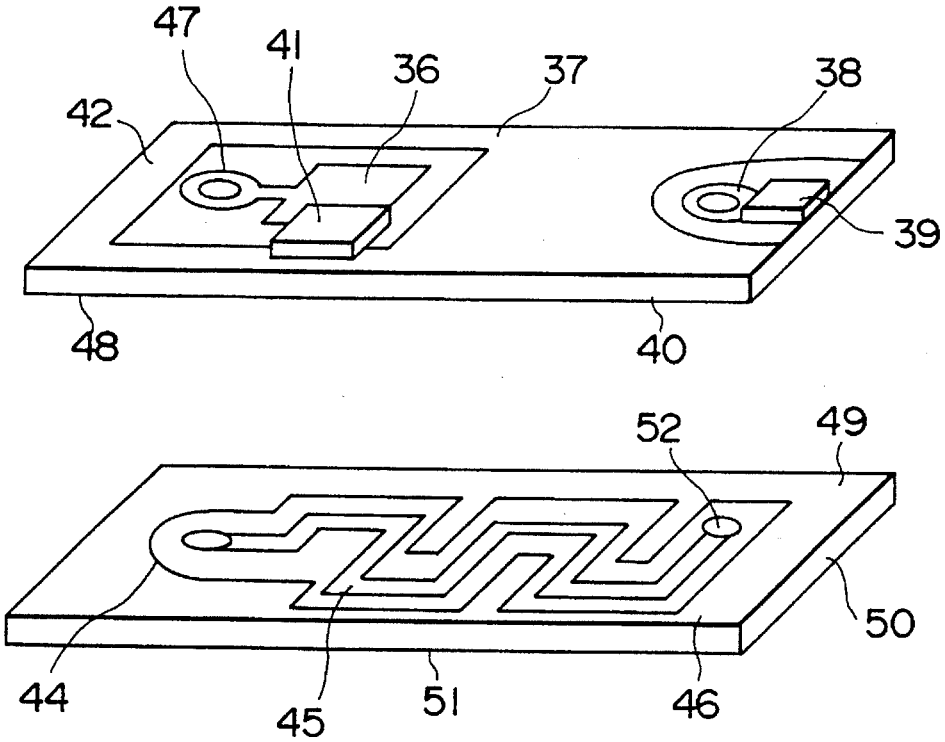
FIG. 7 is a perspective view of a stripline resonator according to a fourth embodiment of this invention.
Figure 8:
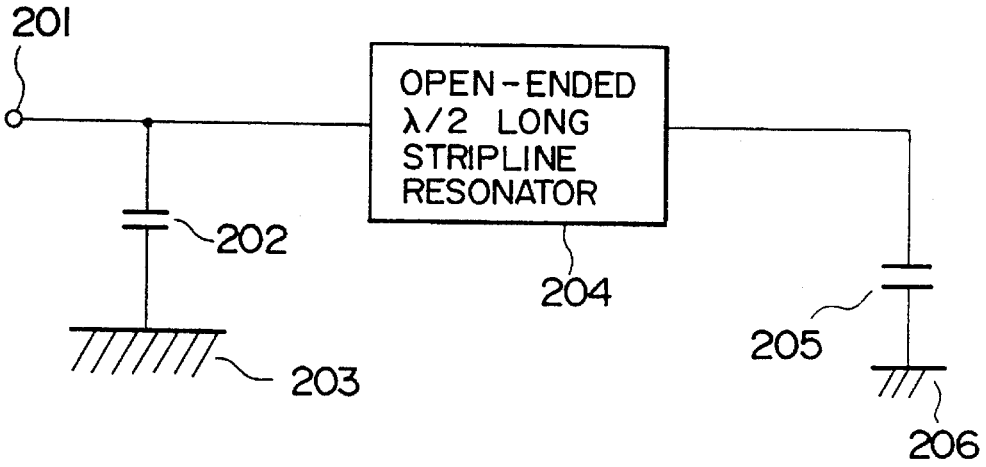
FIG. 8 is an equivalent circuit diagram of the stripline resonator in FIG. 7.

As is illustrated as the fourth embodiment of the present invention in FIG. 7, the capacitor 41 can also be connected in parallel relative to the open-ended λ/2 long stripline 45. Namely, the capacitor 41 is connected at one end thereof to the input terminal 36 and at an opposite end thereof to the plated area formed on the top surface 42. The construction of FIG. 7 is different from the construction of FIG. 5 only in that the capacitor 41, the input terminal 36 and the connecting terminal 47 are connected in different ways as described above. An equivalent circuit of the stripline shown in FIG. 7 can be illustrated as shown in FIG. 8.

When a capacitance $C_o$ is added in parallel to an input terminal, the impedance $Z_{in}$ and the quality factor Q can be expressed by the following formulas (7) and (8):

$$Z_{in}=\frac{Z_0(1+j\omega C_0\alpha l)}{\alpha l+j\omega C_0 Z_0} \quad (7)$$

$$Q=\frac{\omega C_0 Z_0}{1+\omega^2 C_0^2 Z_0^2}\left(\frac{n}{Qs}-Qs\right) \quad (8)$$

where $Z_o$: characteristic impedance of a stripline, l: length of the stripline, al: 1/Q, n: 2, and Qs: Q of the stripline.

The above two formulas indicate that a high quality factor Q is obtained by an increase in the imaginary part of the impedance.

Figure 9:
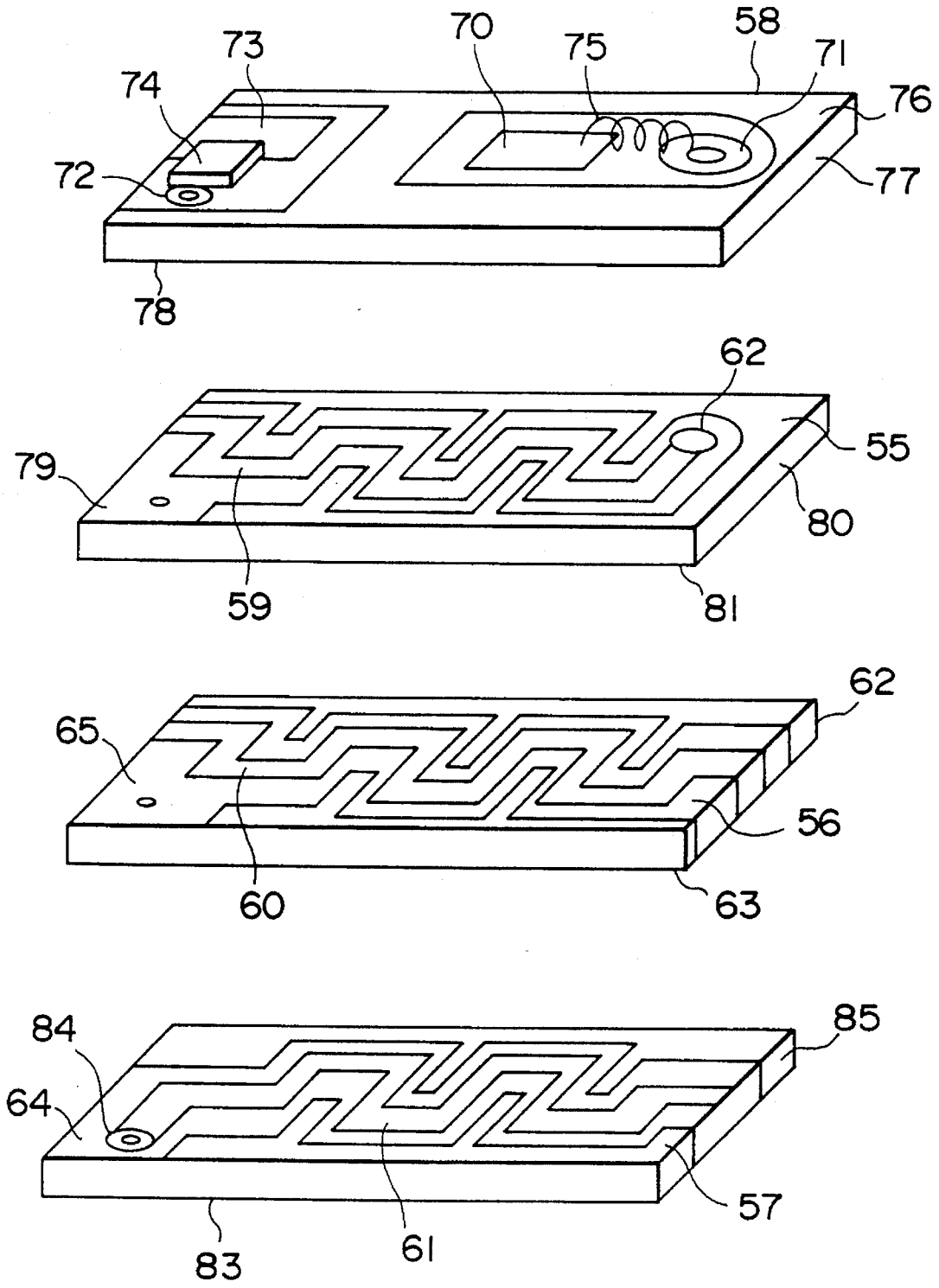
FIG. 9 is a perspective view of a stripline resonator in which an open-ended λ/2 long stripline has been divided into three parts to provide a multilayer structure.
Figure 10:
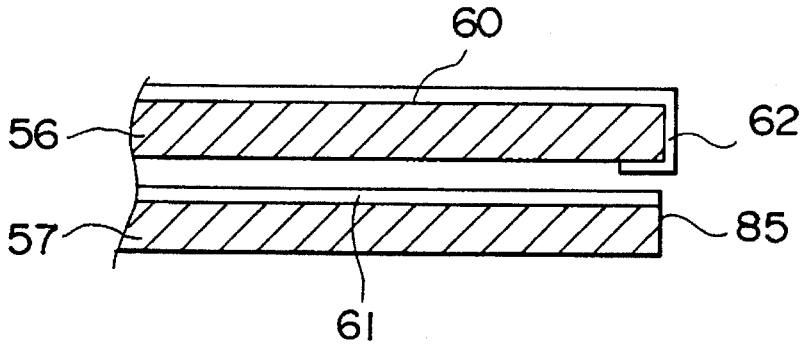
FIG. 10 is a sectional view of an enlarged detail of a portion of in FIG. 9.

Reference is next made to FIGS. 9 and 10, which show the stripline resonator in which the open-ended λ/2 long stripline has been divided into three parts to provide the multilayer structure. Striplines 59,60,61 are arranged on top surfaces 79,65,64 of dielectric plates 55,56,57, respectively. When these three dielectric plates are stacked together, the striplines 59,60,61 are mutually connected at their ends so that a single open-ended λ/2 long stripline is formed. A detailed description will now be made of the connection between the stripline 60 and the stripline 61 when the dielectric plate 56 and the dielectric plate 57 are stacked together.

As is illustrated in FIG. 10, one end portion of the stripline 60 formed on the top surface 65 of the dielectric plate 56 extends continuously from the top surface 65 onto the side surface 62 and further onto a bottom surface 63. In opposition to the position of the stripline 60 arranged on the bottom surface 63, the stripline 61 is disposed on the top surface 64 of the dielectric plate 56. When the dielectric plate 56 and the dielectric plate 57 are stacked together, an end of the stripline 60 and a corresponding end of the stripline 61 are therefore electrically connected.

The connection between the stripline 59 on the dielectric plate 55 and the stripline 60 on the dielectric plate 56 have the above-described construction.

Referring to FIG. 9, a description will hereinafter be made of a construction in which the above three-piece open-ended λ/2 long stripline is employed and the above-described capacitors or coils are incorporated. Arranged on a top surface 76 of a dielectric plate 58 positioned at the top are an input terminal 70, a connecting terminal 71, a terminal 72 and a ground electrode 73. The input terminal 70 and the connecting terminal 71 are connected together via a coil 75. The terminal 72 and the ground electrode 73 are connected together via a capacitor 74. The terminal 72 and the connecting terminal 71 centrally defines through-holes. These through-holes extend from the top surface 76 to a bottom surface 78. An inner wall of each through-hole is plated. In registration with the through-hole formed in the terminal 72 on the dielectric plate 58, through-holes are formed in the remaining dielectric plates 59,60,61, respectively. Inner walls of these through-holes are also plated.

On the top surface 79 of the dielectric plate 55 positioned underneath the dielectric plate 58, the contact 66 and the stripline 59 are arranged. The contact 66 is electrically connected to the above-described connecting terminal 71 via the corresponding through-hole. The stripline 59 is connected at one end thereof to the contact 66 and in the manner described above with reference to FIG. 10, is connected at an opposite end thereof to one end of the stripline 60 on the dielectric plate 56. Further, the stripline 60 is arranged on the top surface 65 of the dielectric plate 56 positioned underneath the dielectric plate 55. The stripline 60 is connected at one end thereof to the stripline 59 and in the manner described above with reference to FIG. 10, is connected at an opposite end thereof to the stripline 61. The stripline 61 and a contact 84 are arranged on the top surface 64 of the dielectric plate 57 positioned underneath the dielectric plate 56. The strip conductor 61 is connected at one end thereof to the contact 84 and as described above, is connected at an opposite end thereof to the stripline 60. The contact 84 is electrically connected to the terminal 72 via the plated inner walls of the through-holes formed in the individual dielectric plates.

A description will next be made of plated areas of each dielectric plate. The top surface 76 of the dielectric plate 58 is plated except for areas—where the input terminal 70, the coil 75, the connecting terminal 71, the terminal 72, the capacitor 74 and the ground electrode are arranged, respectively—and areas extending over a predetermined distance from the contours of the first-mentioned areas. The side surface 77 is plated over the entire area thereof in continuation with the plated area on the top surface 76. The bottom surface 78 is plated except for an area, which is brought into contact with the stripline 59 arranged on the dielectric plate 55 when the dielectric plate 58 and the dielectric plate 55 are stacked together, and an area extending over a predetermined distance from the contour of the first-mentioned area.

The top surface 79 and side surface 80 of the dielectric plate 55 are plated except for areas—where the contact 66, the stripline 59 and the through-holes are arranged, respectively—and areas extending over a predetermined distance from the contours of the first-mentioned areas. The bottom surface 81 is plated except for an area, which is brought into contact with the stripline 60 arranged on the dielectric plate 56 when the dielectric plate 55 and the dielectric plate 56 are stacked together, and an area extending over a predetermined distance from the contour of the first-mentioned area.

The top surface 65 and side surface 62 of the dielectric plate 56 are plated except for areas—where the stripline 60 and the through-holes are arranged, respectively—and areas extending over a predetermined distance from the contours of the first-mentioned areas. The bottom surface 63 is plated except for an area, which is brought into contact with the stripline 61 arranged on the dielectric plate 57 when the dielectric plate 56 and the dielectric plate 57 are stacked together, and an area extending over a predetermined distance from the contour of the first-mentioned area. The top surface 64 and side surface 85 of the dielectric plate 57 are plated except for areas—where the stripline 61 is arranged—and areas extending over a predetermined distance from the contours of the first-mentioned areas. The bottom surface 83 is plated over the entire area thereof.

As will be explained below, an equivalent circuit of the stripline resonator in FIG. 9 can be illustrated as shown in FIG. 4. The route of the input terminal 401→the inductance 402→the open-ended λ/2 long stripline resonance circuit 403→the capacitance 404→the ground 405 in FIG. 4 is therefore equivalent to the route of the input terminal 70→the coil 75→the connecting terminal 71→the contact 62→the striplines 59,60, 61→the contact 84→the through-hole→the capacitor 74→the ground electrode 73.

By changing the coil 75 to a capacitor and connecting the input terminal 70 to the connecting terminal via a capacitor in FIG. 9, the construction of the equivalent circuit of FIG. 6, which was described in connection with the third embodiment, can be realized.

By changing the dielectric plate 58 in FIG. 9 to the dielectric plate 1 in FIG. 1, connecting the input terminal 2 to the contact 62 and connecting the terminal 4 to the contact 84 via the through-hole, the construction of the equivalent circuit of FIG. 2, which was described in connection with the first embodiment, can also be realized.

Figure 11:
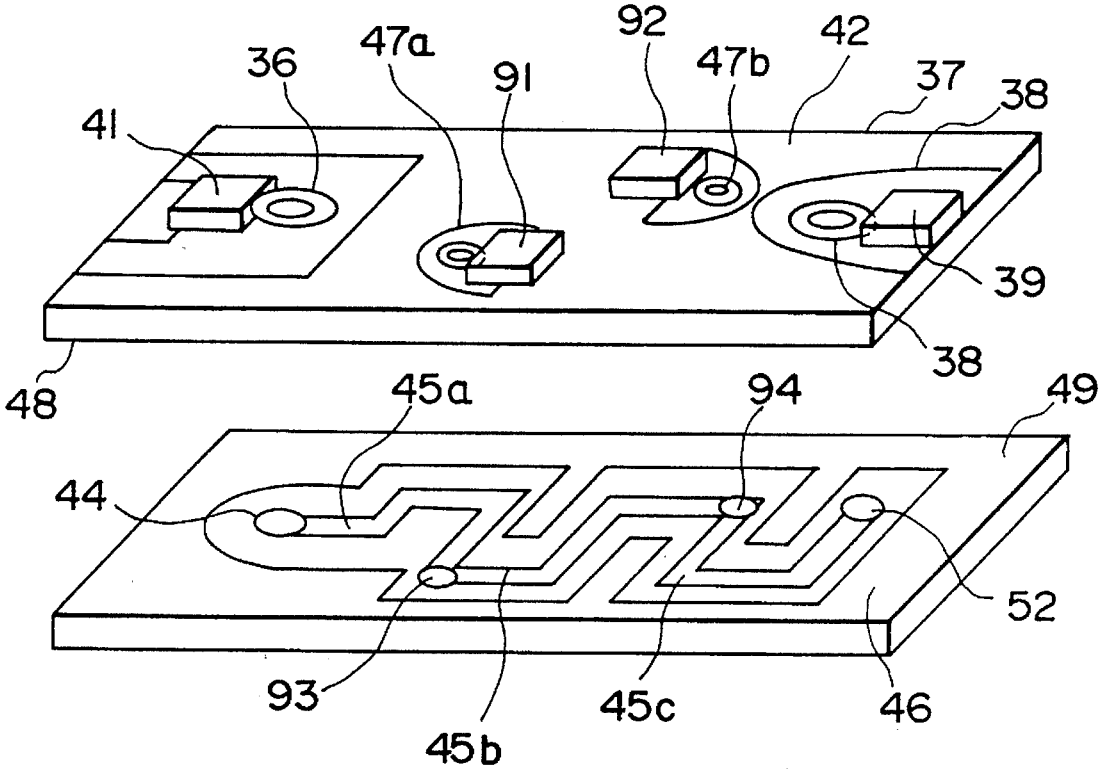
FIG. 11 is a perspective view of a stripline resonator in which an open-ended λ/2 long stripline has been divided into three parts and inductance elements are connected between adjacent stripline parts, to an upstream side of the first stripline part and to a downstream side of the last stripline part, respectively.

Referring next to FIG. 11, the embodiment in which an open-ended λ/2 long stripline is constructed in a divided form on a single dielectric plate will be described. FIG. 11 is a perspective view in which the open-ended λ/2 long stripline described above with reference to FIG. 5 has been divided into three parts. In FIG. 11, element of structure identical to the corresponding elements in FIG. 5 are identified by like reference numerals and their description is omitted herein.

Figure 5:
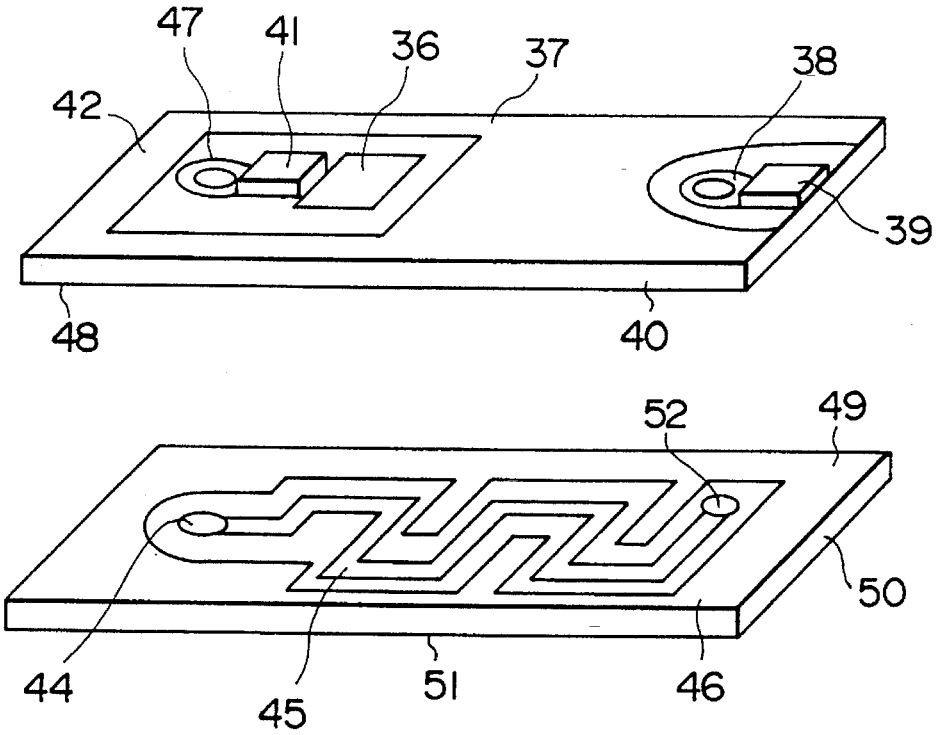
FIG. 5 is a perspective view of a stripline resonator according to a third embodiment of this invention.
Figure 6:
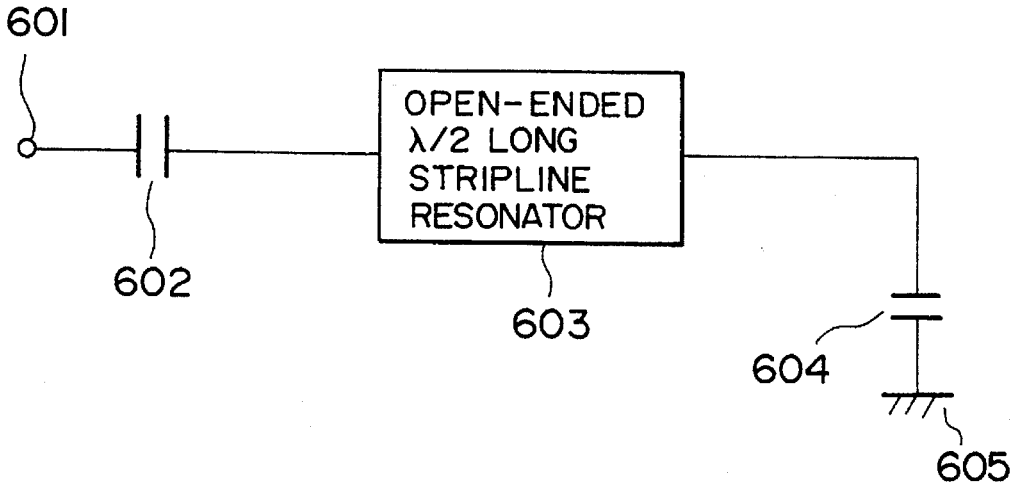
FIG. 6 is an equivalent circuit diagram of the stripline resonator in FIG. 5.

In FIG. 11, striplines 45*a*,45*b*,45*c* which have been formed by dividing into three parts the open-ended λ/2 long stripline 45 shown in FIG. 5 are arranged on a top surface 49 of a dielectric plate 46. The stripline 45*a* is connected at one end thereof to a contact 44 and at an opposite end thereof to one end of the stripline 45*b* via a contact 93. An opposite end of the stripline 45*b* is connected to one end of the stripline 45*c* via a contact 94. Further, an opposite end of the stripline 35*c* is connected to a contact 52.

On the other hand, a top surface 42 of a dielectric plate 37 is provided with connecting terminals 47*a*,47*b* and capacitors 91,92 in addition to the elements shown in FIG. 5. The connecting terminals 47*a*,47*b* centrally define through-holes which extend from the top surface 42 to a bottom surface 48. An inner wall of each through-hole is plated. On the bottom surface 48, electrode patterns of the same shape as the connecting terminal 47*a* or 47*b* are formed around outer peripheries of the through-holes, respectively, although the electrode patterns are not illustrated in FIG. 11. When the dielectric plate 37 and the dielectric plate 46 are stacked together, these electrode patterns are brought into contact with a contact 93 and a contact 94 arranged on a top surface 49 of the dielectric plate 46, respectively.

Incidentally, the plating applied on the top surface 42 of the dielectric plate 37 is not applied in this embodiment at areas, where the connecting terminals 47*a*,47*b* are arranged, respectively, and areas extending over a predetermined distance from the contours of the first-mentioned areas. Further, the connecting terminal 47*a* is connected to the plated area via the capacitor 91, while the connecting terminal 47*b* is connected to the plated area via the capacitor 92.

When the dielectric plate 37 and the dielectric plate 46 are stacked together, the contact 93 and the connecting terminal 47*a* as well as the contact 94 and the connecting terminal 47*b* are hence electrically connected together via the plated inner walls of the corresponding through-holes in addition to electrical connection between the input terminal 36 and the contact 44 and that between the contact 52 and the terminal 38. As a consequence, the stripline resonator of FIG. 11 can be illustrated by the equivalent circuit of FIG. 12.

Figure 12:
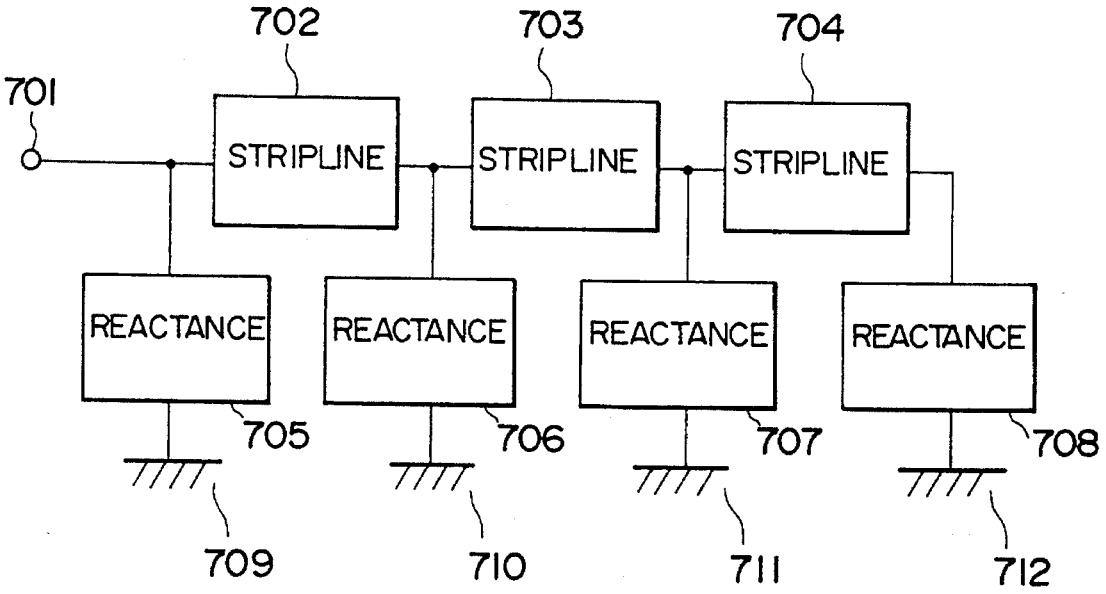
FIG. 12 is an equivalent circuit diagram of the stripline resonator in FIG. 11.

In FIG. 12, divided striplines 702,703,704 are connected in series. An input terminal 701 is connected to one end of the divided stripline 702. A reactance 705 is connected at one end thereof in series between the input terminal 701 and the stripline 702 and at an opposite end thereof to a ground 709. Further, a reactance 706 is connected at one end thereof in series between the striplines 702 and 703 and at an opposite end thereof to a ground 710. In addition, a reactance 707 is connected at one end thereof in series between the striplines 703 and 704 and at an opposite end thereof to a ground 711.

The route of the input terminal 701→the striplines 702, 703,704→the reactance 708→the ground 712 in FIG. 12 is thus equivalent to the route of the connecting terminal 47→the contact 44→the striplines 45*a*,45*b*,45*c* →the terminal 38→the capacitor 39→the side surface 40 in FIG. 11. Further, the reactances 705,706,707,708 correspond to the capacitors 41,91,92,39, respectively.

When a stripline resonator is divided into two parts or three parts, the input impedances $Z_{in2}$,$Z_{in3}$ and quality factors $Q_2$,$Q_3$ can be expressed as will be described next.

$Z_{in2}$ can be expressed by the following formula (9):

$$Z_{in2}=\frac{\frac{\alpha l}{n}+\frac{\omega^2C_1^2\alpha l}{n\cdot Z_0^2}+j\omega C_1Z_0\left(\frac{\alpha^2l^2}{n^2-1}\right)}{\frac{\alpha^2l^2}{n^2}+\omega^2C_1^2Z_0^2}\cdot Z_0+\frac{\frac{\alpha l}{n}+\frac{\omega^2C_2^2\alpha l}{nZ_0^2}+j\omega C_2\left(\frac{\alpha^2l^2}{n^2-1}\right)}{\frac{\alpha^2l^2}{n^2}+\omega^2C_2^2Z_0^2}\cdot Z_0 \tag{9}$$

$Q_2$ can be expressed by the following formula (10):

$$Q_2=\left|\frac{\frac{1}{\omega C_1Z_0}-\frac{1}{\omega C_2Z_0}}{\frac{\alpha l}{n}\left(\frac{1+\omega^2C_1^2Z_0^2}{\omega^2C_1^2Z_0^2}+\frac{1+\omega^2C_2^2Z_0^2}{\omega^2C_2^2Z_0^2}\right)}\right|=2\cdot Qs\frac{\omega^2C_1^2C_2^2Z_0^2}{C_1^2(1+\omega^2C_2^2Z_0^2)+C_2^2(1+\omega^2C_1^2Z_0^2)}\cdot\left(\frac{1}{\omega C_1Z_0}+\frac{1}{\omega C_2Z_0}\right) \tag{10}$$

where $Z_o$: characteristic impedance of a stripline, l: length of the stripline, al: 1/Q, n: 2, ω: resonance frequency, and $Q_s$: Q of the stripline.

When experimental data on the two-piece stripline resonator are similarly divided into three parts, $Z_{in3}$ can be expressed by the following formula (11):

$$Z_{in3}=Z_{in2}\frac{\frac{\alpha l}{n}+\frac{\omega^2C_2^2\alpha l}{nZ_0^2}+j\omega C_3Z_0\left(\frac{\alpha^2l^2}{n^2-1}\right)}{\frac{\alpha^2l^2}{n^2}+\omega^2C_3^2Z_0^2}\cdot Z_0 \tag{11}$$

$Q_3$ can be expressed by the following formula (12):

$$Q_3=3Q_s\frac{\omega^2C_1^2C_2^2C_3^2Z_0^2}{C_1^2C_2^2(1+\omega^2C_3^2Z_0^2)+C_2^2C_3^2(1+\omega^2C_1^2Z_0^2)+C_3^2C_1^2(1+\omega^2C_2^2Z_0^2)}\cdot\left(\frac{1}{\omega C_1Z_0}+\frac{1}{\omega C_2Z_0}+\frac{1}{\omega C_3Z_0}\right) \tag{12}$$

where $Z_o$: characteristic impedance of a stripline, l: length of the stripline, al: 1/Q, n: 3, ω: resonance frequency, and $Q_s$: Q of the stripline.

A high quality factor Q is therefore obtained by an increase in the imaginary part of the impedance.

In the illustrated embodiment, the capacitors are connected between the divided striplines. Similar effects can be obtained when inductances, for example, coils 96,97,98,99 are similarly connected in place of the capacitors 41,91,92, 39 as depicted in FIG. 13.

In the illustrated embodiment, divided striplines are employed as the striplines 702,703,704. It is however borne in mind that the present invention is not limited to the use of such divided striplines. Similar effects can also be obtained when an open-ended λ/2 long stripline is arranged on the dielectric plate 46 and the contacts 93,94 are arranged on the open-ended λ/2 long stripline. Experimental data on stripline resonators having capacitance circuits arranged between divided striplines are shown in FIGS. 14 and 15.

Figures 13, 14:
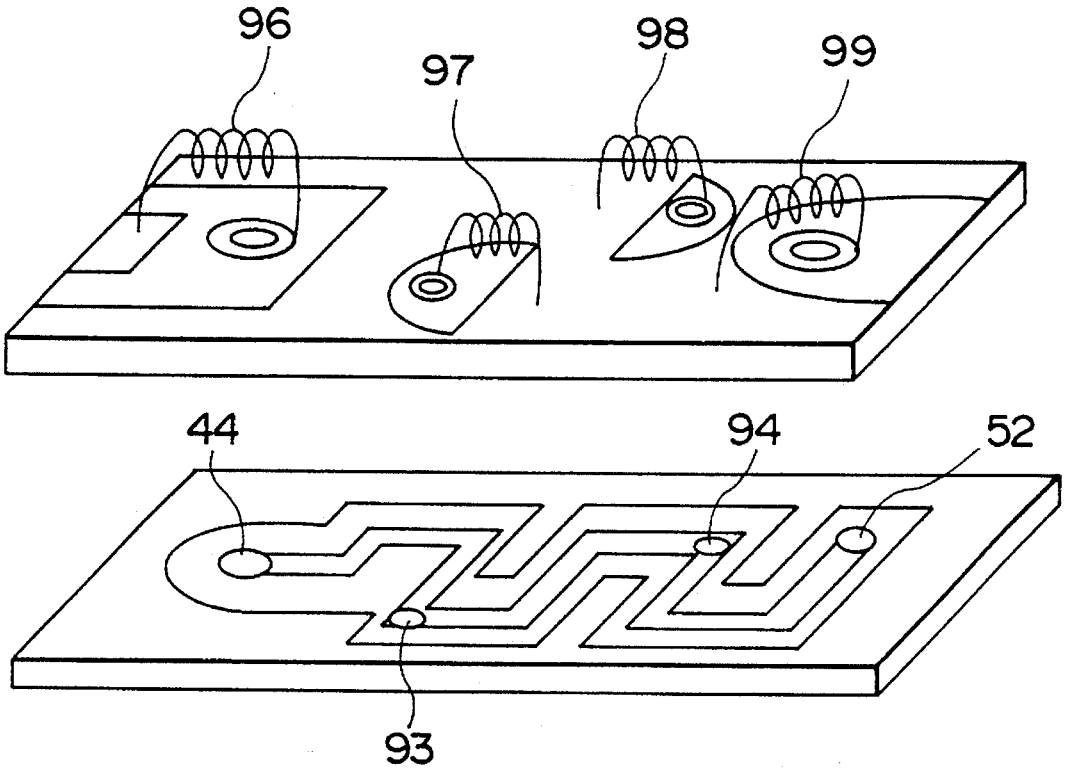
FIG. 13 is a perspective view of another stripline resonator in which an open-ended λ/2 long stripline has been divided into three parts and inductance elements are connected between adjacent stripline parts, to an upstream side of the first stripline part and to a downstream side of the last stripline part, respectively.
FIG. 14 shows a table of experimental data of a stripline divided into two parts.
Figure 16:
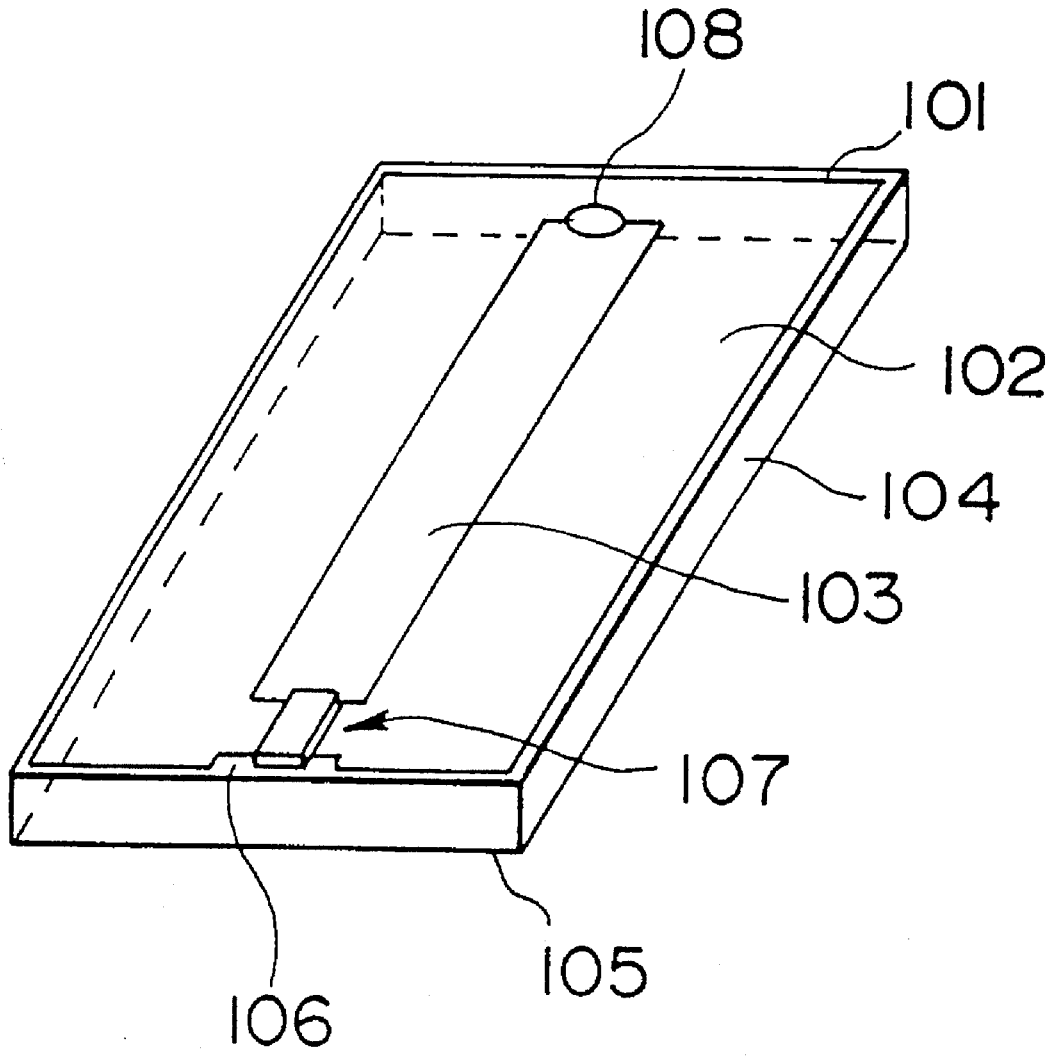
FIG. 16 is a perspective view of a conventional stripline resonator.

FIG. 14 shows a table of experimental data of a stripline divided into two parts. The data shown in FIG. 14 were obtained by changing the values of capacitors arranged between the divided striplines. According to the results of the experiment, it is appreciated that a stripline resonator having a capacitance added between divided parts of a stripline has higher Q than a stripline resonator not added with such capacitances.

FIG. 15 illustrates a table of experimental data of a stripline divided into three parts. FIG. 15 shows experimental data obtained by changing the values of capacitors arranged between an input terminal and the stripline while fixing the values of the capacitors arranged between the divided striplines in view of the data of FIG. 15. From these results, it is also understood that a stripline resonator with capacitances added between divided striplines has a higher Q than a stripline resonator not added with any capacitance.

What is claimed is:

1. A stripline resonator, comprising:

an input terminal;

an open-ended λ/2 long stripline arranged on a dielectric plate;

a first reactance element having one end connected to said input terminal and an opposite end connected to one end of said open-ended λ/2 long stripline; and a second reactance element having one end connected to an opposite end of said open-ended λ/2 long stripline and an opposite end which is grounded.

2. A stripline resonator comprising:

a first dielectric plate and a second dielectric plate arranged in a multilayer structure, wherein said first dielectric plate includes:

a ground electrode, an input terminal extending from a top surface to a bottom surface of said first dielectric plate and electrically connecting said top surface and said bottom surface, a short-ended stripline having one end connected to said input terminal on a side of said top surface and an opposite end connected to said ground electrode and having an inductance component, a connecting terminal extending from said top surface to said bottom surface and electrically connecting said top surface and said bottom surface, and a capacitance element having one end connected to said connecting terminal on the side of said top surface and an opposite end connected to said ground electrode; and said second dielectric plate includes an open-ended λ/2 long stripline, said first dielectric plate and said second dielectric plate being stacked together, and said open-ended λ/2 long stripline having one end connected to said input terminal on a side of said bottom surface and an opposite end connected to said connecting terminal on the side of said bottom surface.

3. A stripline resonator according to claim 2, wherein said open-ended λ/2 long stripline is divided into a plurality of parts and arranged on said first and second dielectric plates.

4. A stripline resonator, comprising:

a first dielectric plate and a second dielectric plate arranged in a multilayer structure, wherein said first dielectric plate includes:

a ground electrode, a first connecting terminal extending from a top surface to a bottom surface of said first dielectric plate and electrically connecting said top surface and said bottom surface, an inductance element having one end connected to an input terminal on a side of said top surface and an opposite end connected to said first connecting terminal on the side of said top surface, a second connecting terminal extending from said top surface to said bottom surface and electrically connecting said top surface and said bottom surface, and a capacitance element having one end connected to said second connecting terminal on the side of said top surface and an opposite end connected to said ground electrode; and said second dielectric plate includes:

an open-ended λ/2 long stripline, said first dielectric plate and said second dielectric plate being stacked together, and said open-ended λ/2 long stripline having one end connected to said input terminal on a side of said bottom surface and an opposite end connected to said second connecting terminal on the side of said bottom surface.

5. A stripline resonator according to claim 4, wherein said open-ended λ/2 long stripline is divided into a plurality of parts and arranged on said first and second dielectric plates.

6. A stripline resonator comprising:

a first dielectric plate and a second dielectric plate arranged in a multilayer structure, wherein said first dielectric plate includes:

a ground electrode, an input terminal on a top surface of said first dielectric plate, a first connecting terminal extending from said top surface to a bottom surface of said first dielectric plate and electrically connecting said top surface and said bottom surface, a first capacitance element having one end connected to said input terminal and an opposite end connected to said first connecting terminal on a side of said top surface, a second connecting terminal extending from said top surface to said bottom surface and electrically connecting said top surface and said bottom surface, a second capacitance element having one end connected to said second connecting terminal on the side of said top surface and an opposite end connected to said ground electrode; and said second dielectric plate includes:

an open-ended λ/2 long stripline, said first dielectric plate and said second dielectric plate being stacked together, said open-ended λ/2 long stripline having one end connected to said input terminal on said bottom surface and an opposite end connected to said second connecting terminal on the side of said bottom surface.

7. A stripline resonator according to claim 6, wherein said open-ended λ/2 long stripline is divided into a plurality of parts and arranged on said first and second dielectric plates.

8. A stripline resonator, comprising:

a first dielectric plate and a second dielectric plate arranged in a multilayer structure, wherein said first dielectric plate includes:

a ground electrode, an input terminal extending from a top surface to a bottom surface of said first dielectric plate and electrically connecting said top surface and said bottom surface, a first capacitance element having one end connected to said input terminal on a side of said top surface and an opposite end connected to said ground electrode, a connecting terminal extending from said top surface to said bottom surface and electrically connecting said top surface and said bottom surface, and a second capacitance element having one end connected to said connecting terminal on the side of said top surface and an opposite end connected to said ground electrode; and said second dielectric plate includes:

an open-ended λ/2 long stripline, said first dielectric plate and said second dielectric plate being stacked together, said open-ended λ/2 long stripline having one end connected to said input terminal on a side of said bottom surface and an opposite end connected to said connecting terminal on the side of said bottom surface.

9. A stripline resonator according to claim 8, wherein said open-ended λ/2 long stripline is divided into a plurality of parts and arranged on said first and second dielectric plates.

10. A stripline resonator, comprising:

a first dielectric plate and a second dielectric plate arranged in a multilayer structure, wherein said first dielectric plate includes:

a ground electrode, an input terminal extending from a top surface to a bottom surface of said first dielectric plate and electrically connecting said top surface and said bottom surface, a first reactance element having one end connected to said input terminal on a side of said top surface and an opposite end connected to said ground electrode, a connecting terminal extending from said top surface to said bottom surface and electrically connecting said top surface and said bottom surface, a second reactance element having one end connected to said connecting terminal on the side of said top surface and an opposite end connected to said ground electrode, at least one connecting electrode extending from said top surface to said bottom surface and electrically connecting said top surface and said bottom surface, and a third reactance element having one end connected to said connecting electrode on the side of said top surface and an opposite end connected to said ground electrode; and said second dielectric plate includes:

an open-ended λ/2 long stripline, and at least one contact arranged on said open-ended λ/2 long stripline, wherein said first dielectric plate and said second dielectric plate are stacked together, said open-ended λ/2 long stripline has one end connected to said input terminal on a side of said bottom surface and an opposite end connected to said connecting terminal on the side of said bottom surface, and said contact is connected to said connecting electrode on the side of said bottom surface.

* * * * *